US007218235B1

(12) United States Patent
Rainey

(10) Patent No.: US 7,218,235 B1
(45) Date of Patent: May 15, 2007

(54) MOTION RESPONSIVE SWIMMING POOL SAFETY DEVICE

(76) Inventor: Jeffrey L. Rainey, 4832 Baroque Ter., Oceanside, CA (US) 92057

( * ) Notice: Subject to any disclaimer, the term of this patent is extended or adjusted under 35 U.S.C. 154(b) by 362 days.

(21) Appl. No.: 10/955,454

(22) Filed: Sep. 30, 2004

(51) Int. Cl.
*G08B 23/00* (2006.01)

(52) U.S. Cl. ..... 340/573.6; 340/566; 340/521; 340/573.1; 340/557; 4/488; 4/498

(58) Field of Classification Search ..... 340/566, 340/574, 573.1, 540, 573.6, 541, 552, 555–557, 340/517, 521; 4/488, 504, 495, 498, 507–508
See application file for complete search history.

(56) References Cited

U.S. PATENT DOCUMENTS

| | | | | |
|---|---|---|---|---|
| 4,129,905 | A | 12/1978 | Niemirow | |
| 4,747,168 | A | 5/1988 | Sing | |
| 4,955,092 | A * | 9/1990 | Hagan | 4/502 |
| 5,025,247 | A * | 6/1991 | Banks | 340/574 |
| 5,091,714 | A | 2/1992 | De Solminihac | |
| D342,142 | S | 12/1993 | Jablonski | |
| 5,832,547 | A | 11/1998 | Burroughs | |
| 5,874,898 | A * | 2/1999 | Peralta et al. | 340/573.6 |
| 6,127,930 | A * | 10/2000 | Steffanus | 340/573.1 |
| 6,574,804 | B1 * | 6/2003 | Boujon | 4/504 |
| 6,625,824 | B1 * | 9/2003 | Lutz et al. | 4/507 |
| 6,822,566 | B2 * | 11/2004 | Matthews et al. | 340/555 |
| 6,899,582 | B1 * | 5/2005 | Hayles | 441/80 |

FOREIGN PATENT DOCUMENTS

FR 2789787 * 8/2000

* cited by examiner

*Primary Examiner*—Daniel Wu
*Assistant Examiner*—Daniel Previl

(57) ABSTRACT

A motion responsive swimming pool safety device that has a control panel. A perimeter laser electrically is connected to the control panel. The perimeter laser is located peripheral to the swimming pool and generates a perimeter laser beam. A perimeter sensor is electrically connected to the control panel. The perimeter sensor is located peripherally to the swimming pool and is capable of sensing the perimeter laser beam. A perimeter alert is electrically connected to the control panel. The perimeter alert is capable of alarming upon interruption of the perimeter laser beam to the perimeter sensor.

3 Claims, 7 Drawing Sheets

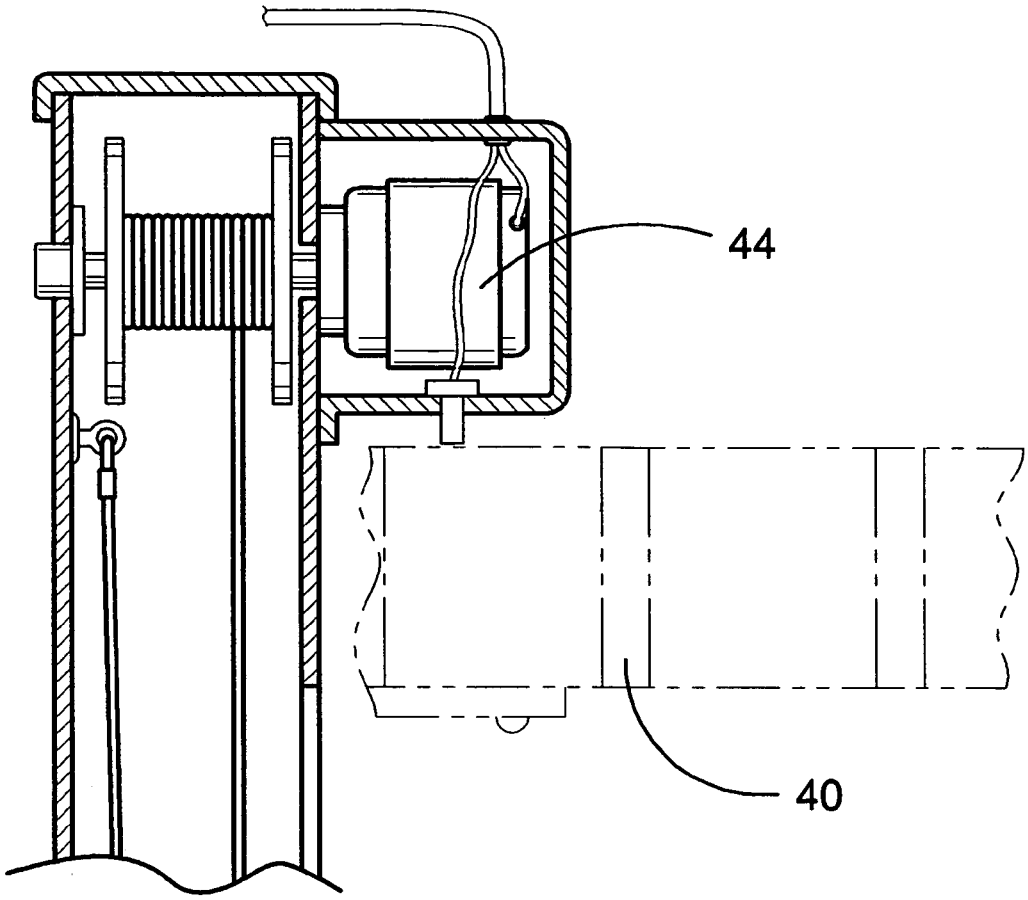
FIG. 6
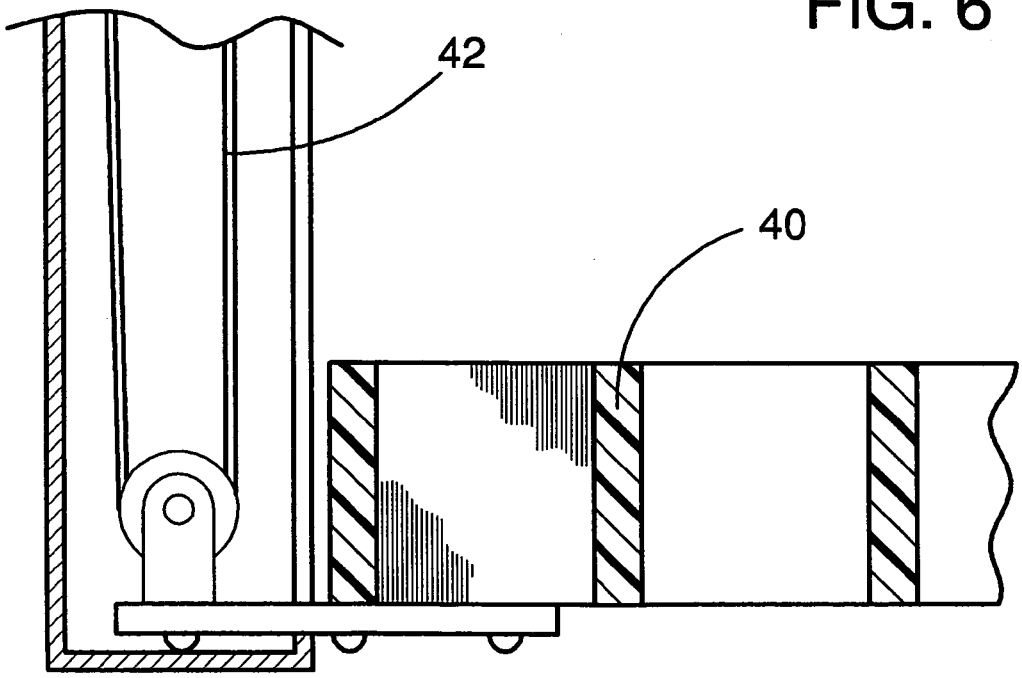

MOTION RESPONSIVE SWIMMING POOL SAFETY DEVICE

FIELD OF THE INVENTION

The present invention relates to a motion responsible swimming pool safety device for use in connection with swimming pool safety devices. The motion responsive swimming pool safety device has particular utility in connection with automatic rescue devices for swimming pools utilizing safety grids.

DESCRIPTION OF THE PRIOR ART

Motion responsive swimming pool safety devices are desirable for protecting young children from accidentally drowning in swimming pools. Many individuals do not own swimming pools for fear that their children will wander into the pool unnoticed. A need has been felt for a warning and rescue system that sounds an alarm when a pool is approached while the alarm is in place, sounding progressively more acute alarms as the water's edge is approached. Also, a safety grid rises when the water's surface is breached, thus preventing a drowning.

The use of swimming pool safety devices is known in the prior art. For example, U.S. Pat. No. 5,832,547 to Burroughs discloses a swimming pool automatic rescue device that is comprised of a safety net coextensive with the perimeter of the pool. The device is submerged in the water when inactive having metal arms fastened to corners thereof, hollow cylinders running from the pool bottom to just above the top of water surface standing at corners of the pool that house collapsible rods. In certain modes, minimal action by a human, namely operation of a remote activator, is necessary. When the swimming pool is not in use, an infra red signaling system is activated causing an electrical signal to travel through wires to activate motors at the bottom of each cylinder. However, the Burroughs '547 patent does not disclose a series of alarm perimeters that are set by laser beam, and does not have a laser beam sweep the water's surface to insure that there are no unsecured dead spots in the security grid, and does not have the capability of placing an emergency services phone call.

Similarly, U.S. Pat. No. 6,127,930 to Steffanus discloses a motion responsive swimming pool safety mat that is an automatically inflatable mattress adapted to rest on a bottom of a swimming pool in its deflated position. The device inflates using compressed air pumped through air inflation lines that are coiled around spring loaded hose reels. A microprocessor actuates a compressed air pump as a person interrupts a signal pattern produced by microwave sensors disposed around the perimeter of the swimming pool. The mattress uniformly rises up to the surface of the swimming pool to catch a distressed individual whose motion is detected after falling into the water. However, the Steffanus '930 patent does not disclose a series of alarm perimeters that are set by laser beam, does not have a laser beam sweep the water's surface and does not have the capability of placing an emergency services phone call.

Lastly, U.S. Pat. No. 4,129,905 to Niemirow discloses a swimming pool rescue net that can immediately rise to water's surface by means of inflatable bladder associated therewith to prevent drowning of endangered victims. However, the Niemirow '905 patent does not disclose a series of alarm perimeters that are set by laser beam, does not have a laser beam sweep the water's and does not have the capability of placing an emergency services phone call.

While the above-described devices fulfill their respective, particular objectives and requirements, the aforementioned patents do not describe a motion responsive swimming pool safety device that allows automatic rescue devices for swimming pools utilizing safety grids. The Burroughs '547, Steffanus '930 and Niemirow '905 patents make no provision for a series of alarm perimeters that are set by laser beam, do not have a laser beam sweep the water's surface and does not have the capability of placing an emergency services phone call.

Therefore, a need exists for a new and improved motion responsive swimming pool safety device that can be used for automatic rescue devices for swimming pools utilizing safety grids. In this regard, the present invention substantially fulfills this need. In this respect, the motion responsive swimming pool safety device according to the present invention substantially departs from the conventional concepts and designs of the prior art, and in doing so provides an apparatus primarily developed for the purpose of automatic rescue devices for swimming pools utilizing safety grids.

SUMMARY OF THE INVENTION

In view of the foregoing disadvantages inherent in the known types of swimming pool safety devices now present in the prior art, the present invention provides an improved motion responsive swimming pool safety device, and overcomes the above-mentioned disadvantages and drawbacks of the prior art. As such, the general purpose of the present invention, which will be described subsequently in greater detail, is to provide a new and improved motion responsive swimming pool safety device and method which has all the advantages of the prior art mentioned heretofore and many novel features that result in a motion responsive swimming pool safety device which is not anticipated, rendered obvious, suggested, or even implied by the prior art, either alone or in any combination thereof.

To attain this, the present invention essentially comprises a perimeter laser electrically connected to a control panel. The perimeter laser is located peripheral to the swimming pool and generates a perimeter laser beam. A perimeter sensor is electrically connected to the control panel. The perimeter sensor is located peripherally to the swimming pool and is capable of sensing the perimeter laser beam. A perimeter alert is electrically connected to the control panel. The perimeter alert is capable of alarming upon interruption of the perimeter laser beam to the perimeter sensor. A sweeping laser is electrically connected to the control panel. The sweeping laser is located at the perimeter of the pool above the pool water line, the sweeping laser generating a sweeping laser beam. A sweeping laser sensor is electrically connected to the control panel, the sweeping laser sensor is located at the perimeter of the pool above the pool water line, the sweeping laser sensor capable of sensing the sweeping laser beam. A water entry alarm is electrically connected to the control panel, the water entry alarm is capable of alarming upon interruption of the sweeping laser beam to the sweeping laser sensor. There has thus been outlined, rather broadly, the more important features of the invention in order that the detailed description thereof that follows may be better understood and in order that the present contribution to the art may be better appreciated.

The invention may also include a safety grid, a safety cable, an electrical motor, a housing transparent dome, a housing dome ring, a housing base, a pool side wall transparent cover, a pool side wall gasket, an on-site alarm housing, an on-site alarm beacon, and an on-site alarm siren. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved motion responsive swimming pool safety device that has all of the advantages of the prior art swimming pool safety devices and none of the disadvantages.

It is another object of the present invention to provide a new and improved motion responsive swimming pool safety device that may be easily and efficiently manufactured and marketed.

An even further object of the present invention is to provide a new and improved motion responsive swimming pool safety device that has a low cost of manufacture with regard to both materials and labor, and which accordingly is then susceptible of low prices of sale to the consuming public, thereby making such motion responsive swimming pool safety device economically available to the buying public.

Still another object of the present invention is to provide a new motion responsive swimming pool safety device that provides in the apparatuses and methods of the prior art some of the advantages thereof, while simultaneously overcoming some of the disadvantages normally associated therewith.

Even still another object of the present invention is to provide a motion responsive swimming pool safety device for automatic rescue devices for swimming pools utilizing safety grids.

Yet still another object of the present invention is to provide a motion responsive swimming pool safety device that includes a durable plastic floor mounted to a mechanical pulley system for raising victims out of the water.

Lastly, it is an object of the present invention is to provide a motion responsive swimming pool safety device that offers progressive alarms and deploys a safety net when the water surface is breached.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is a cross-sectional view of item 6 of FIG. 1 of the motion responsive swimming pool safety device of the present invention.

The same reference numerals refer to the same parts throughout the various figures.

DESCRIPTION OF THE PREFERRED EMBODIMENT

Figure 1:
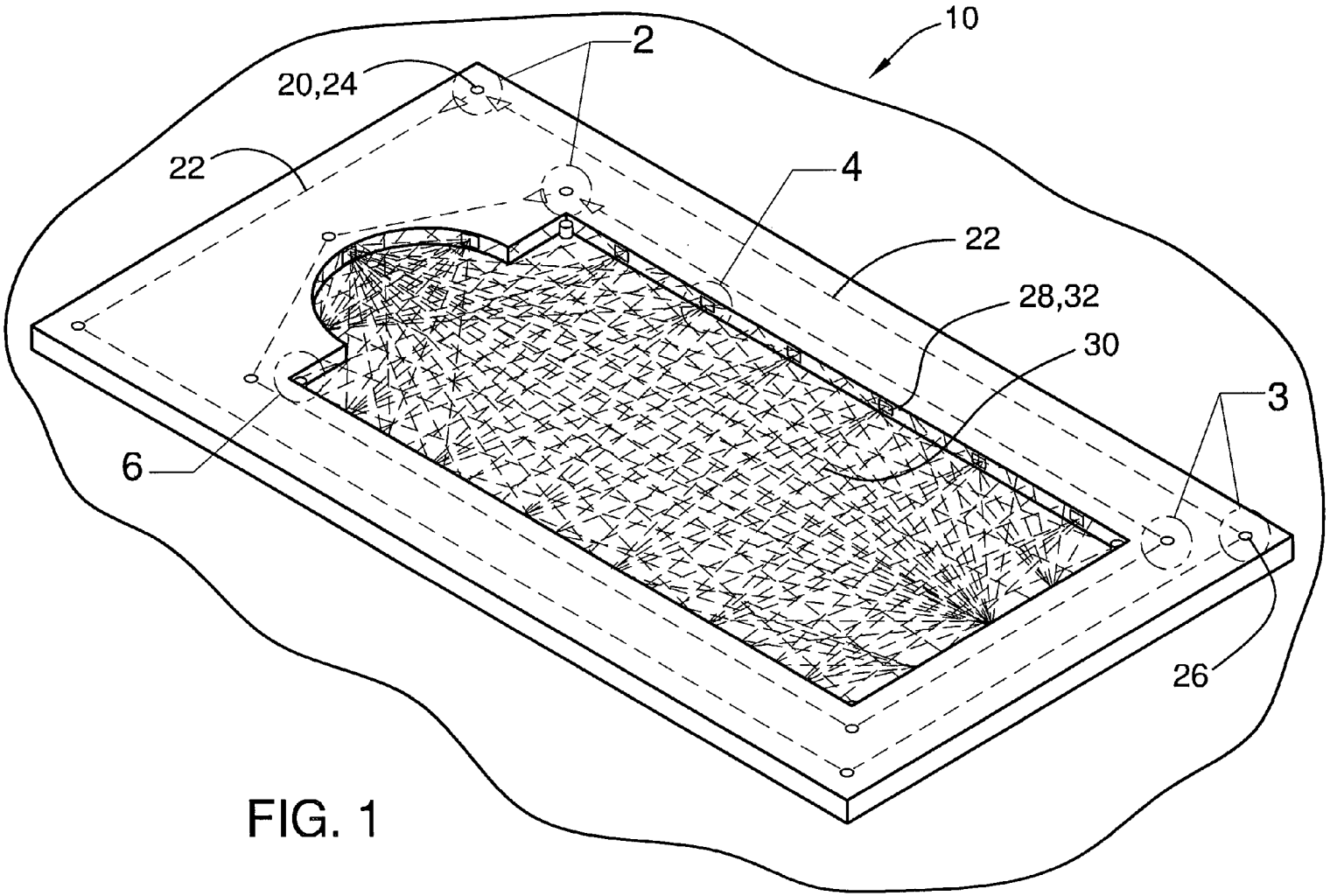
FIG. 1 is a top perspective view of the preferred embodiment of the motion responsive swimming pool safety device constructed in accordance with the principles of the present invention.

Referring now to the drawings, and particularly to FIGS. 1–7, a preferred embodiment of the motion responsive swimming pool safety device of the present invention is shown and generally designated by the reference numeral 10.

In FIG. 1, a new and improved motion responsive swimming pool safety device 10 of the present invention for automatic rescue devices for swimming pools utilizing safety grids is illustrated and will be described. More particularly, the motion responsive swimming pool safety device 10 has a perimeter laser 20 electrically connected to a control panel 12 (shown in FIG. 7). The perimeter laser 20 is located peripherally to the swimming pool. The perimeter laser 20 generates a perimeter laser beam 22. A perimeter sensor 24 is electrically connected to the control panel 12. The perimeter sensor 24 is located peripherally to the swimming pool. The perimeter sensor 24 is capable of sensing the perimeter laser beam 22. A perimeter alert 14 (shown in FIG. 7) is electrically connected to the control panel 12. The perimeter alert 14 is capable of alarming upon interruption of the perimeter laser beam 22 to the perimeter sensor 24. A perimeter reflector 26 is located peripherally to the swimming pool. The perimeter reflector 26 is used for reflecting the perimeter laser beam 22. A sweeping laser 28 is electrically connected to the control panel 12. The sweeping laser 28 is located at the perimeter of the pool above the pool water line. The sweeping laser 28 generates a sweeping laser beam 30. A sweeping laser sensor 32 is electrically connected to the control panel 12. The sweeping laser sensor 32 is located at the perimeter of the pool above the pool water line. The sweeping laser sensor 32 is capable of sensing the sweeping laser beam 30. A water entry alarm 16 (shown in FIG. 7) is electrically connected to the control panel 12. The water entry alarm 16 is capable of alarming upon interruption of the sweeping laser beam 30 to the sweeping laser sensor 32.

Figure 2:
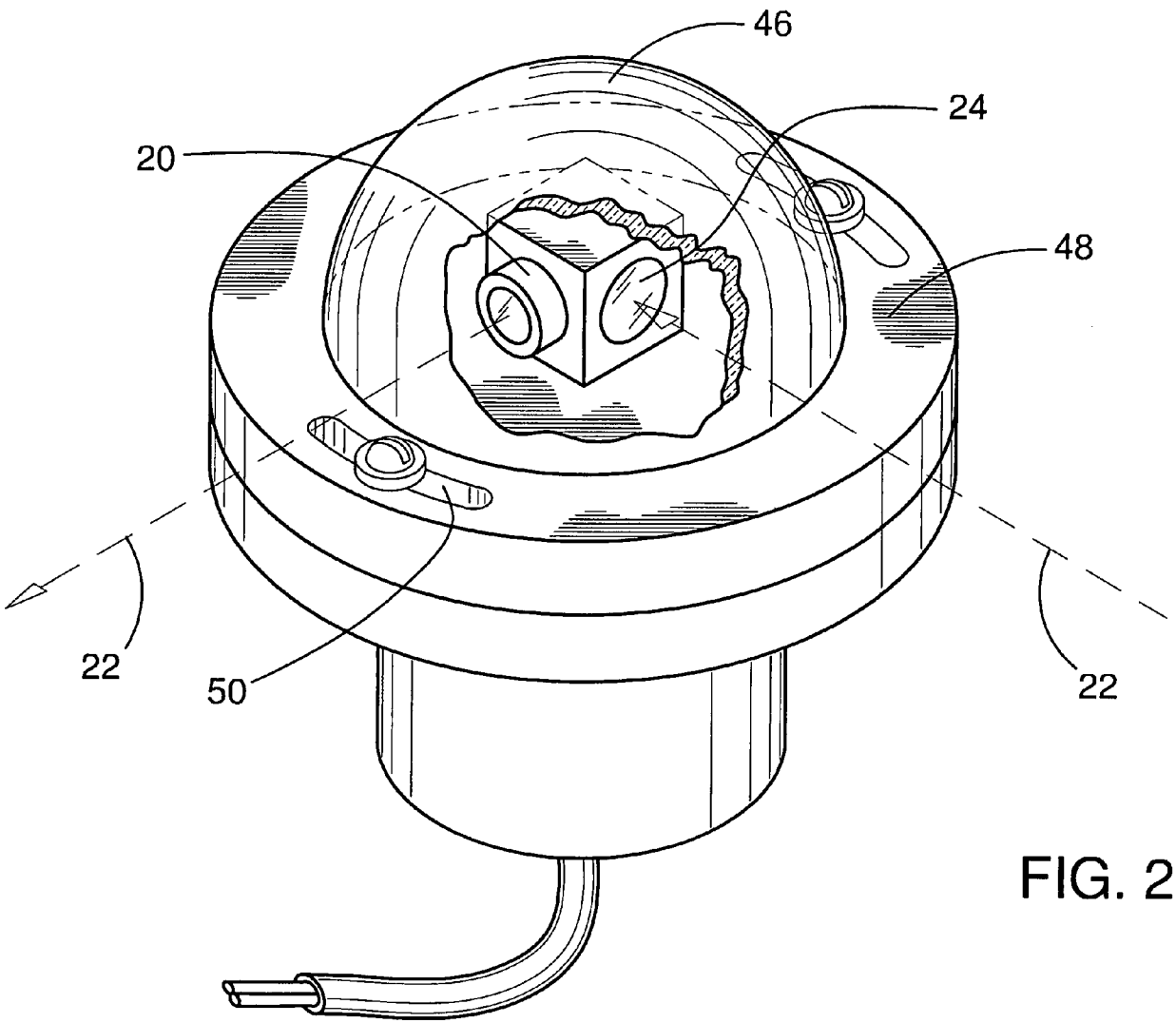
FIG. 2 is a top perspective view of item 2 of FIG. 1 of the motion responsive swimming pool safety device of the present invention.

In FIG. 2, the motion responsive swimming pool safety device 10 is illustrated and will be described. The motion responsive swimming pool safety device 10 has the perimeter laser 20 electrically connected to the control panel 12 (shown in FIG. 7). The perimeter laser 20 is located peripherally to the swimming pool. The perimeter laser 20 generates the perimeter laser beam 22. The perimeter sensor 24 is electrically connected to the control panel 12. The perimeter sensor 24 is located peripherally to the swimming pool. The perimeter sensor 24 is capable of sensing the perimeter laser beam 22. The perimeter alert 14 (shown in FIG. 7) is electrically connected to the control panel 12. The perimeter alert 14 is capable of alarming upon interruption of the perimeter laser beam 22 to the perimeter sensor 24. A housing dome ring 48 is connected to a housing transparent dome 46. The housing dome ring 48 has an adjustment slot 50 therein. A housing base 52 is connected to the housing dome ring 48. The housing base 52 is capable of attachment to the perimeter laser 20. The housing base 52 is capable of attachment to the perimeter sensor 24.

Figure 3:
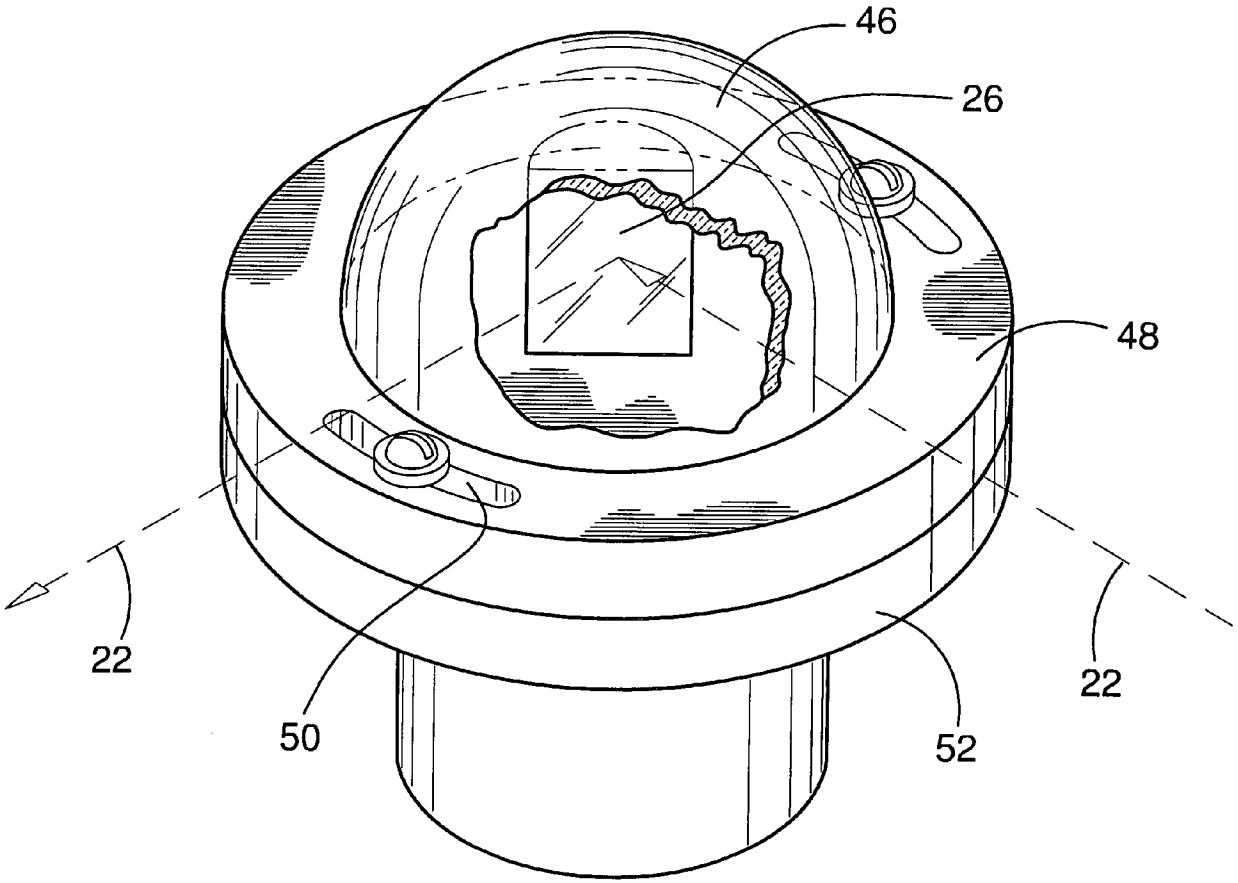
FIG. 3 is a top perspective view of item 3 of FIG. 1 of the motion responsive swimming pool safety device of the present invention.

In FIG. 3, the motion responsive swimming pool safety device 10 is illustrated and will be described. The perimeter reflector 26 is located peripherally to the swimming pool. The perimeter reflector 26 is used for reflecting the perimeter laser beam 22. The sweeping laser 28 is electrically connected to the control panel 12 (shown in FIG. 7). The housing dome ring 48 is connected to the housing transparent dome 46. The housing dome ring 48 has the adjustment slot 50 therein. The housing base 52 is connected to the housing dome ring 48. The housing base 52 is capable of attachment to the perimeter reflector 26.

Figure 4:
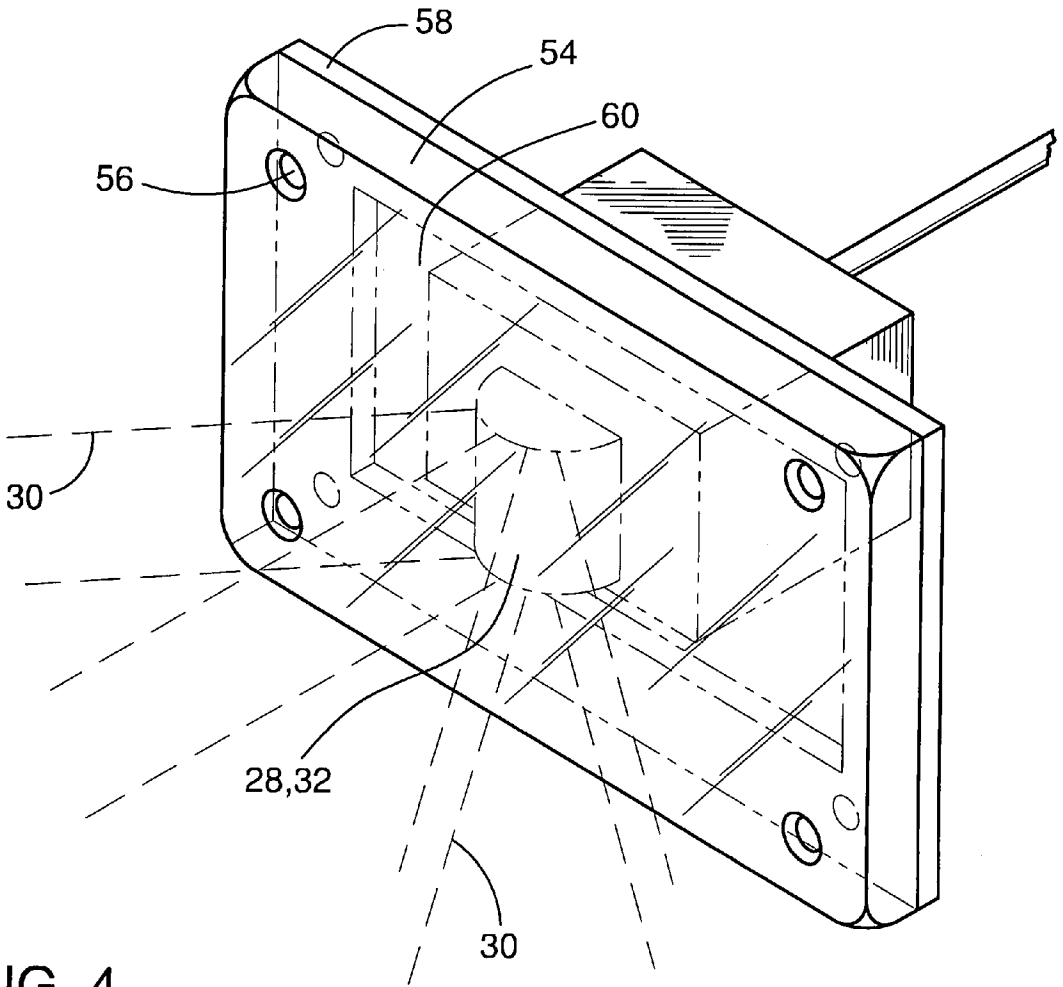
FIG. 4 is a top perspective view of item 4 of FIG. 1 of the motion responsive swimming pool safety device of the present invention.

In FIG. 4, the motion responsive swimming pool safety device 10 is illustrated and will be described. The sweeping laser 28 is electrically connected to the control panel 12. The sweeping laser 28 is located at the perimeter of the pool above the pool water line. The sweeping laser 28 generates the sweeping laser beam 30. The sweeping laser sensor 32 is electrically connected to the control panel 12 (shown in FIG. 7). The sweeping laser sensor 32 is located at the perimeter of the pool above the pool water line. The sweeping laser sensor 32 is capable of sensing the sweeping laser beam 30. The water entry alarm 16 (shown in FIG. 7) is electrically connected to the control panel 12. The water entry alarm 16 is capable of alarming upon interruption of the sweeping laser beam 30 to the sweeping laser sensor 32. A pool side wall transparent cover 54 has a plurality of mounting holes 56. The pool side wall transparent cover 54 is capable of mounting to the pool perimeter wall. The pool side wall transparent cover 54 is located directly in front of the sweeping laser 28. The pool side wall transparent cover 54 is located directly in front of the sweeping laser sensor 32. A pool side wall gasket 58 has a scan slot 60 therein. The pool side wall gasket 58 is connected to the pool side wall transparent cover 54.

Figure 5:
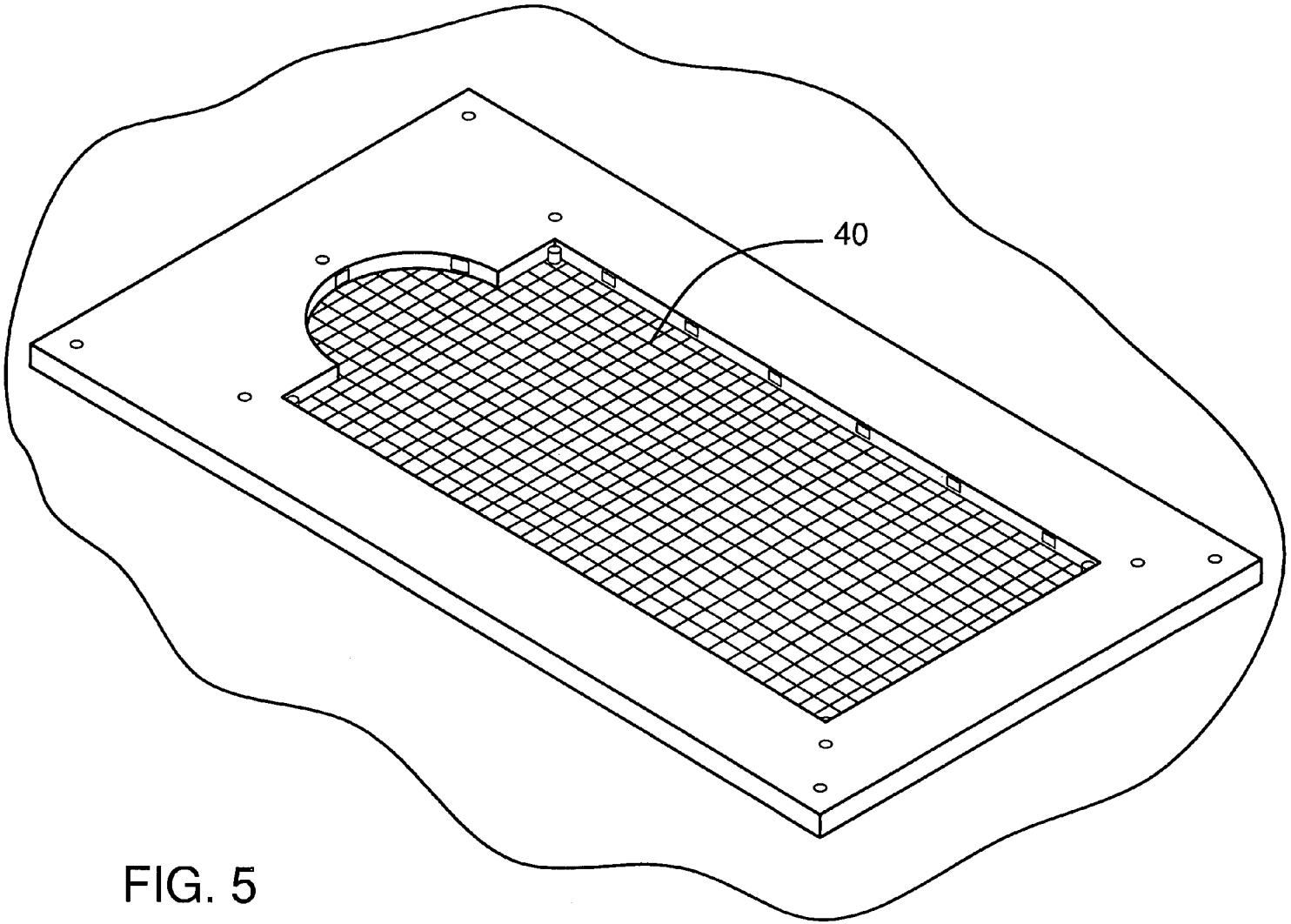
FIG. 5 is a top perspective view of the safety grid of motion responsive swimming pool safety device of the present invention.

In FIG. 5, the motion responsive swimming pool safety device 10 is illustrated and will be described. A safety grid 40 is coextensive with the perimeter of the pool. The safety grid 40 is rigid and has substantially the form of grating.

In FIG. 6, the motion responsive swimming pool safety device 10 is illustrated and will be described. The safety grid 40 is coextensive with the perimeter of the pool. The safety grid 40 is rigid and has substantially the form of grating. A safety cable 42 is attached to the safety grid 40. An electrical motor 44 is electrically connected to the control panel 12. The electrical motor 44 is rotatively connected to the safety cable. The control panel 12 is capable of selective actuation of the electrical motor 44 upon actuation of the perimeter alert 14 or the water entry alarm 16 (both 14 and 16 shown in FIG. 7).

Figure 7:
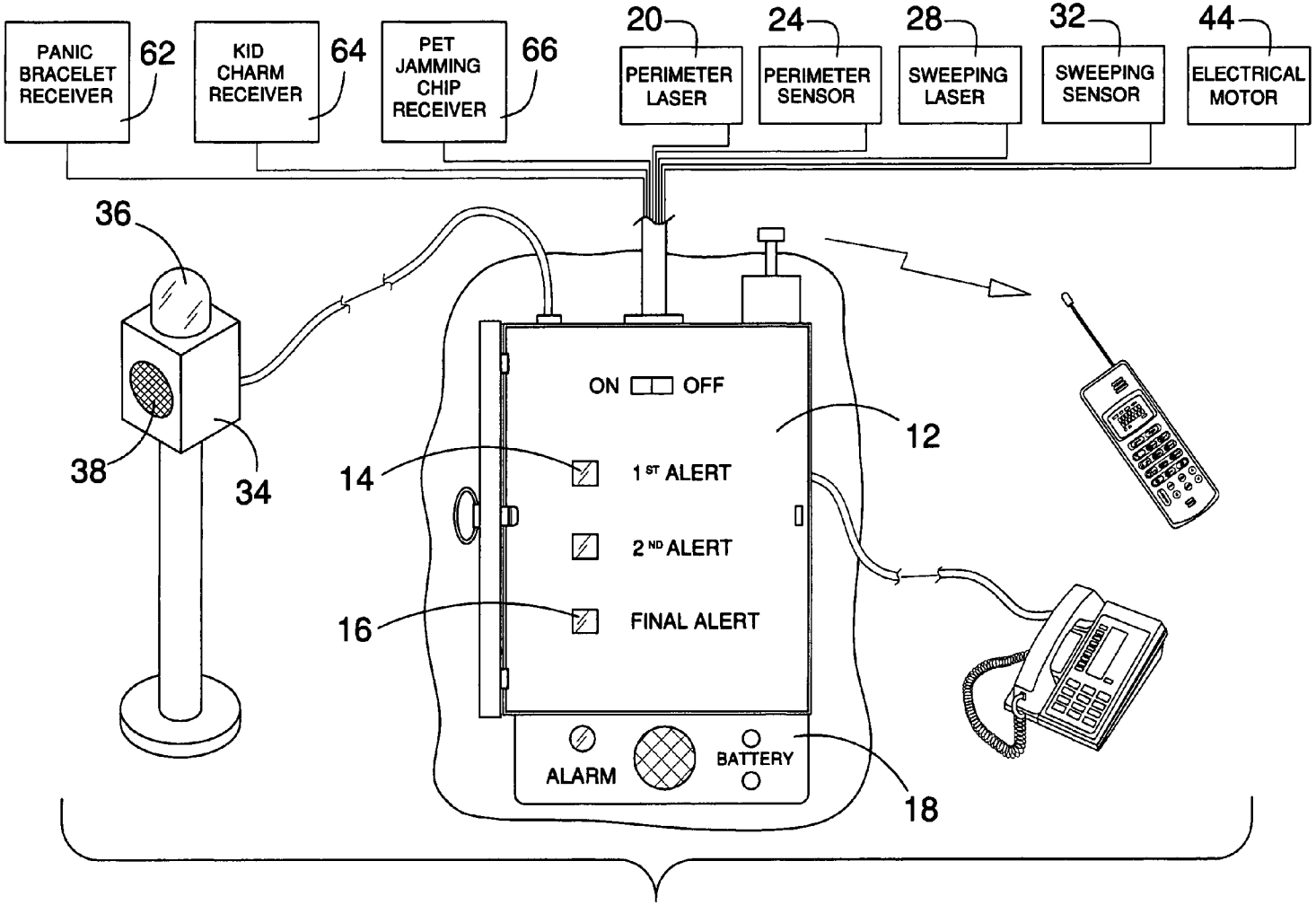
FIG. 7 is a diagram view of the motion responsive swimming pool safety device of the present invention.

In FIG. 7, the motion responsive swimming pool safety device 10 is illustrated and will be described. The motion responsive swimming pool safety device 10 has the perimeter laser 20 electrically connected to the control panel 12. The perimeter sensor 24 is electrically connected to the control panel 12. The perimeter alert 14 is electrically connected to the control panel 12. The perimeter alert 14 is capable of alarming upon interruption of the perimeter laser beam 22 to the perimeter sensor 24. The sweeping laser 28 is electrically connected to the control panel 12. The sweeping laser sensor 32 is electrically connected to the control panel 12. The water entry alarm 16 is electrically connected to the control panel 12. The water entry alarm 16 is capable of alarming upon interruption of the sweeping laser beam 30 to the sweeping laser sensor 32. An on-site alarm tower housing 34 is located adjacent to the pool. An on-site alarm beacon 36 is attached to the on-site alarm tower housing 34. The on-site alarm beacon 36 is electrically connected to the control panel 12. The on-site alarm beacon 36 alarms concurrent with the water entry alarm 16. An on-site alarm siren 38 is attached to the on-site alarm tower housing 34. The on-site alarm siren 38 is electrically connected to the control panel 12. The on-site alarm siren 38 alarms concurrent with the water entry alarm 16. The control panel 12 is capable of placing the emergency services phone call upon actuation of the water entry alarm 16. The control panel 12 is capable of placing the cell phone call upon actuation of the water entry alarm 16. A battery backup 18 is electrically connected to the control panel 12 for powering the alarm in the case of the power interruption. The control panel 12 is capable of selective actuation of the electrical motor 44 to pull up the safety grid 40 upon actuation of the perimeter alert 14 or the water entry alarm 16. A wireless panic bracelet receiver 62 is electrically connected to the control panel 12. The panic bracelet receiver 62 is capable of receiving a panic bracelet alarm signal. A wireless panic bracelet transmitter 68 is capable of transmitting the panic bracelet alarm signal. A wireless kid charm chip receiver 64 is electrically connected to the control panel 12. The kid charm chip receiver 64 is capable of receiving a kid charm chip proximity signal. A wireless kid charm chip transmitter 70 is capable of transmitting the kid charm chip proximity signal. A wireless pet jamming chip receiver 66 is electrically connected to the control panel 12. The pet jamming chip receiver 66 is capable of receiving a pet jamming chip proximity signal. A wireless pet jamming chip transmitter 72 is capable of transmitting the pet jamming chip proximity signal.

In use, it can now be understood that the motion responsive swimming pool safety grid 10 has the safety grid 40 that is activated by the perimeter alert or by water entry alarm. The safety grid 40 is raised from the floor of the pool, and the control panel 12 places emergency service calls and calls the owner's cell phone.

While a preferred embodiment of the motion responsive swimming pool safety device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable plastic or composite may be used instead of the metal described. Also, the laser may be in a visible or invisible color range. And although automatic rescue devices for swimming pools utilizing safety grids have been described, it should be appreciated that the motion responsive swimming pool safety device herein described is also suitable for progressively alarming based on proximity to any stationary danger.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A motion responsive swimming pool safety device comprising:

a control panel;

a perimeter laser electrically connected to said control panel, said perimeter laser located peripherally to said swimming pool, said perimeter laser generating a perimeter laser beam;

a perimeter sensor electrically connected to said control panel, said perimeter sensor located peripherally to said swimming pool, said perimeter sensor capable of sensing said perimeter laser beam;

a perimeter alert electrically connected to said control panel, said perimeter alert capable of alarming upon interruption of said perimeter laser beam to said perimeter sensor;

a perimeter reflector located peripherally to said swimming pool, said perimeter reflector for reflecting said perimeter laser beam;

a housing transparent dome;

a housing dome ring connected to said housing transparent dome, said housing dome ring having an adjustment slot therein;

an housing base connected to said housing dome ring, said housing base capable of attachment to said perimeter laser, said housing base capable of attachment to said perimeter sensor;

a pool side wall transparent cover having a plurality of mounting holes, said cover capable of mounting to the pool perimeter wall, said pool side wall transparent cover located directly in front of said sweeping laser, said pool side wall transparent cover located directly in front of said sweeping laser sensor; and a pool side wall gasket having a scan slot therein, said pool side wall gasket connected to said pool side wall transparent cover.

2. A motion responsive swimming pool safety device comprising:

a control panel;

a sweeping laser electrically connected to said control panel, said sweeping laser located at the Perimeter of the pool above the pool water line, said sweeping laser generating a sweeping laser beam;

a sweeping laser sensor electrically connected to said control panel, said sweeping laser sensor located at the perimeter of the pool above the pool water line, said sweeping laser sensor capable of sensing said sweeping laser beam;

a water entry alarm electrically connected to said control panel, said water entry alarm capable of alarming upon interruption of said sweeping laser beam to said sweeping laser sensor;

a perimeter laser electrically connected to said control panel, said perimeter laser located peripherally to said swimming pool, said perimeter laser generating a perimeter laser beam;

a perimeter sensor electrically connected to said control panel, said perimeter sensor located peripherally to said swimming pool, said perimeter sensor capable of sensing said perimeter laser beam;

a perimeter reflector located peripherally to said swimming pool, said perimeter reflector for reflecting said perimeter laser beam;

a perimeter alert electrically connected to said control panel, said perimeter alert capable of alarming upon interruption of said perimeter laser beam to said perimeter sensor;

a housing transparent dome;

a housing dome ring connected to said housing transparent dome, said housing dome ring having an adjustment slot therein;

a housing base connected to said housing dome ring, said housing base capable of attachment to said perimeter laser, said housing base capable of attachment to said perimeter sensor, said housing base capable of attachment to said perimeter reflector;

a pool side wall transparent cover having a plurality of mounting holes, said cover capable of mounting to the pool perimeter wall, said pool side wall transparent cover located directly in front of said sweeping laser, said pool side wall transparent cover located directly in front of said sweeping laser sensor; and a pool side wall gasket having a scan slot therein, said pool side wall gasket connected to said pool side wall transparent cover.

3. A motion responsive swimming pool safety device comprising:

a control panel;

a sweeping laser electrically connected to said control panel, said sweeping laser located at the perimeter of the pool above the pool water line, said sweeping laser generating a sweeping laser beam;

a sweeping laser sensor electrically connected to said control panel, said sweeping laser sensor located at the perimeter of the pool above the pool water line, said sweeping laser sensor capable of sensing said sweeping laser beam;

a water entry alarm electrically connected to said control panel, said water entry alarm capable of alarming upon interruption of said sweeping laser beam to said sweeping laser sensor;

a perimeter laser electrically connected to said control panel, said perimeter laser located peripherally to said swimming pool, said perimeter laser generating a perimeter laser beam;

a perimeter sensor electrically connected to said control panel, said perimeter sensor located peripherally to said swimming pool, said perimeter sensor capable of sensing said perimeter laser beam;

a perimeter reflector located peripherally to said swimming pool, said perimeter reflector for reflecting said perimeter laser beam;

a perimeter alert electrically connected to said control panel, said perimeter alert capable of alarming upon interruption of said perimeter laser beam to said perimeter sensor;

a safety grid coextensive with the perimeter of said pool, said safety grid being rigid and having substantially the form of a grating;

a safety cable attached to said safety grid;

an electrical motor electrically connected to said control panel, said electrical motor rotatively connected to said safety cable;

an on-site alarm tower housing located adjacent to said pool;

an on-site alarm beacon attached to said on-site alarm tower housing, said on-site alarm beacon electrically connected to said control panel said on-site alarm beacon alarming concurrent with said water entry alarm;

an on-site alarm siren attached to said on-site alarm tower housing, said on-site alarm siren electrically connected to said control panel, said on-site alarm siren alarming concurrent with said water entry alarm;

a wireless panic bracelet receiver electrically connected to said control panel, said panic bracelet receiver capable of receiving a panic bracelet alarm signal;

a wireless panic bracelet transmitter capable of transmitting said panic bracelet alarm signal;

a wireless kid charm chip receiver electrically connected to said control panel, said kid charm chip receiver capable of receiving a kid charm chip proximity signal;

a wireless kid charm chip transmitter capable of transmitting said kid charm chip proximity signal;

a wireless pet jamming chip receiver electrically connected to said control panel, said pet jamming chip receiver capable of receiving a pet jamming chip proximity signal; and a wireless pet jamming chip transmitter capable of transmitting said pet jamming chip proximity signal.

* * * * *